United States Patent [19]

Nysten

[11] 4,097,969

[45] Jul. 4, 1978

[54] BUTTON HAVING A STITCHLESS FASTENER

[75] Inventor: Bernhard Nysten, Aachen, Fed. Rep. of Germany

[73] Assignee: William Prym-Werke KG, Stolberg, Fed. Rep. of Germany

[21] Appl. No.: 746,324

[22] Filed: Dec. 1, 1976

[30] Foreign Application Priority Data

Dec. 6, 1975 [DE] Fed. Rep. of Germany ..... 2555025

[51] Int. Cl.[2] ..... A44B 1/18

[52] U.S. Cl. ..... 24/90 R; 24/94; 24/113 MP; 24/103

[58] Field of Search ..... 24/94, 113 MP, 90 W, 24/103, 104

[56] References Cited

U.S. PATENT DOCUMENTS

| | | | |
|---|---|---|---|
| 1,088,393 | 2/1914 | Backus | 24/103 |
| 1,220,829 | 3/1917 | Elliott | 24/94 |
| 1,331,401 | 2/1920 | Summers | 24/94 |
| 2,087,074 | 7/1937 | Tucker | 24/113 MP |
| 2,874,433 | 2/1959 | La Rue | 24/103 |
| 2,944,311 | 7/1960 | Schneckenberger | 24/104 |
| 3,142,878 | 8/1964 | Santora | 24/96 |
| 3,596,329 | 8/1971 | Hoban | 24/90 W |
| 3,787,935 | 1/1974 | Kapitan | 24/113 MP |

FOREIGN PATENT DOCUMENTS

| | | | |
|---|---|---|---|
| 79 of | 1884 | United Kingdom | 24/94 |
| 762,658 | 12/1956 | United Kingdom | 24/113 MP |

*Primary Examiner*—Bernard A. Gelak
*Attorney, Agent, or Firm*—Michael J. Striker

[57] ABSTRACT

The present invention provides a button designed to be fastened to a carrier material without the use of stitches. The button includes a button body having two parts, one part being a lower part with a top and bottom surface, the later adapted to lie upon the carrier material, the lower part having at least two apertures through the top and bottom surface and at least two recesses upon the top surface proceeding from the apertures, the other part being an upper part mountable on the lower part above the top surface of the latter. Also provided are means adapted to pass through the carrier material and the apertures, and adapted to lie within the recesses for fastening the lower part to the carrier material.

12 Claims, 8 Drawing Figures

BUTTON HAVING A STITCHLESS FASTENER

BACKGROUND OF THE INVENTION

Conventional techniques apply fastening bodies under conditions in which prongs of the fastening body proceed out of a plate perpendicular to the plane of the plate. In all cases, an instrument is required for the fastening process. The instrument is used to pass the prongs through the carrier material and to stick the prongs through the material of the button. Then, the instrument rolls the prongs into a cavity of the fastening body. It is not practical to sever the button from the carrier without damaging the component parts.

There are also fastening bodies with non-deformable button fasteners. Such fastening bodies consist of nails with broadened heads. The shafts or shanks of the nails are provided with barbs. The barbs cut into the material when the fastening body is driven into the back side of a hole in the button. The quality of the connection depends on the depth of the engagement of the barbs and the strength of the button material. On the other hand, it is difficult to drive the fastening body into the button if the button material is of high strength and the barbs are large. Since it is inevitable that damage to the material will result from driving the barbs into the material, adequate fastening is uncertain.

SUMMARY OF THE INVENTION

It is an object of the present invention to provide a simple button designed for fastening without stitching and which is distinguished by its easy fastening and its certainty of adequate fastening.

According to the invention, the fastening body is formed out of a staple or a curved piece of metal having prongs or teeth upon the inclined ends of its flexible legs. The button body is in two parts. One part is a lower part with a top and bottom surface. Apertures proceed through both surfaces. The legs of a staple are passed through these apertures. The other part of the button member is an upper part which is received on the lower part. The protruding parts of the legs are turned down with a turning motion.

The fitting of the fastening body is very simple. All of the required functions of the fastening body are fulfilled by bending the legs of the staple. It is simplest to use a basically U-shaped staple; the bight piece is below the back side of the carrier material and both legs of the staple are passed through the carrier material and are led through the apertures of the lower part and then fasten the base to the carrier through a simple folding of the ends of the legs. Easiest fastening without the use of a special instrument is achieved through the use of a staple having its legs bent such that the top portions are plumb to the lower portions while the lower portions are coplanar and perpendicular to the bight.

The legs of the staple can be easily fastened through the holes of the disengaged lower part and then the legs can be laid against the top surface of the base by turning the bight in order to allow the lower portion of the legs or intermediate part to enter the apertures. This fastening position will reliably secure the lower part to the carrier material. The turned ends of the legs are received in recesses which are arranged upon the top surface of the lower part. The lower surface of the upper part can be pressed against this top surface. According to one embodiment of the invention, recesses are provided upon facing surfaces of the upper part and the lower part, i.e., the lower surface of the upper part and the upper surface of the lower part. It is simplest, however, to apply the recesses upon the upper surface of the lower part such that the recesses are opposite to and closed off by the lower surface of the upper part.

The recesses may be shaped with large diameters. According to the preferred embodiment, the recesses are in the form of channels. Such a form maximizes the reliable retention of the legs turned down or folded in the chosen directions. It is also preferred that the base be shaped as a bowl or basin with walls circumscribing the upper surface of the lower part forming the floor receiving the upper part. Optionally, four channels may be provided running from the apertures in different directions. The provision of numerous channels is useful in the selective retraction or folding of the staple ends.

Instead of a simple staple form, it is recommended in the preferred embodiment that the staple be better supported on the backside of the carrier by providing an L-shape for both legs of the U-shaped staple. The L-shaped legs are perpendicular to the bight of the staple. The intermediate part or lower portion of the leg forms the base of the "L". The staples are preferably made out of metallic wire, for which sturdy material such as steel or bronze is suitable. In the area of the bight of the staple, it is preferable to provide colored material for the protection of the large area of the carrier surface. Alternatively, one may provide a covering or jacket with a colored elaboration on the interior or back side of the carrier. For the same purposes of protection, the entire staple wire may be covered with a coating of plastic; this plastic coat is colored so as to correspond with the piece of cloth or carrier material.

It is also preferable to provide a predominant amount of plastic around the lower part. This plastic is used to give an elastic construction to the wall surrounding the basin-like lower part. Particularly, the plastic is applied in order to increase the elasticity of the rim or lip of the basin walls receiving a disc-shaped upper part. The upper part should be formed as a disc or plate which is fitted into the basin-shaped lower part. The upper part may be button-like in shape or it may be simply a commercial button in a disc-shape. By using a disc-shape, the appearance of the front side of the button is maintained since the staple legs are not visible. In the preferred embodiment, it is appropriate to construct the lower part and its walls with transparent plastic so that the sides which grip the button disc will not be conspicuous. According to one's taste, one may obtain, through the application of different materials, an additional design or pattern directly upon this ring-shaped rim of the lower part.

It is also preferable to provide, upon the outer and lower side of the lower part, elevations forming a button shank. The provision of the button shank has the advantage of reinforcing the center of the lower part in the interior region of the lower part in which the legs are folded.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE DRAWING

Figure 1:
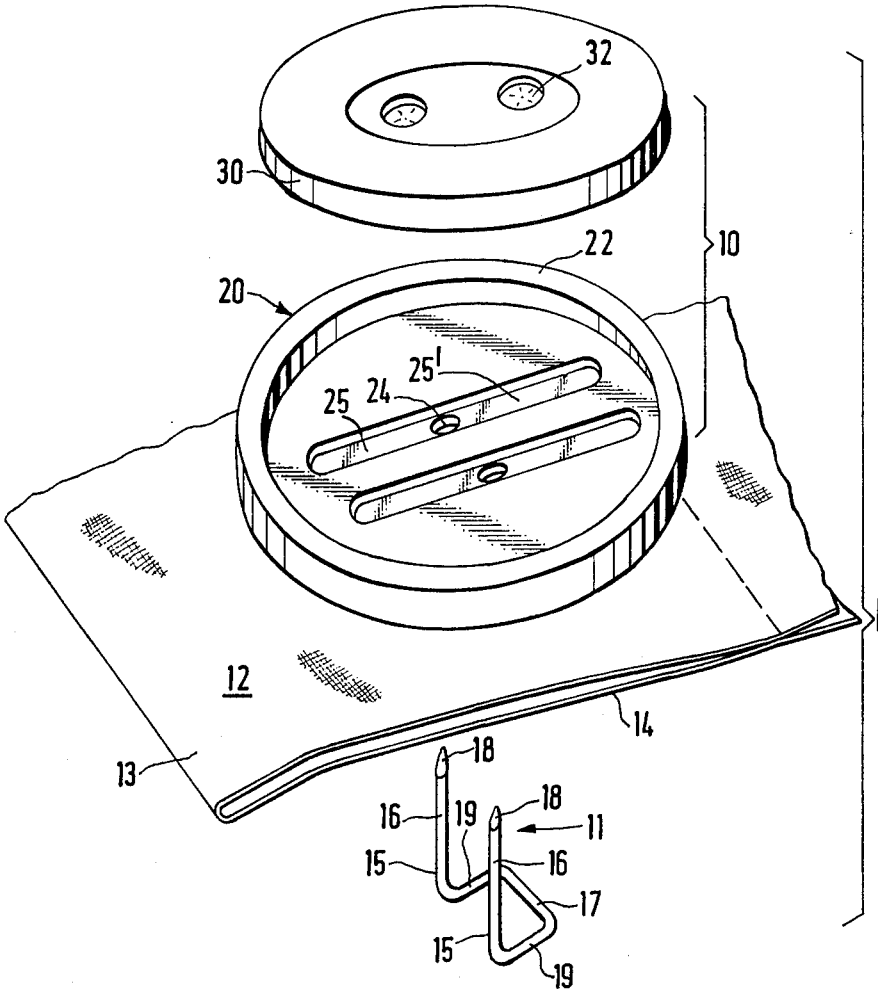
FIG. 1 is an exploded perspective view of the component parts of the invented button prior to fitting the upper part in the lower part above the carrier.
Figure 6A:
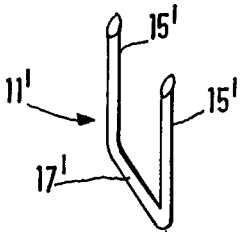
Figure 6B:
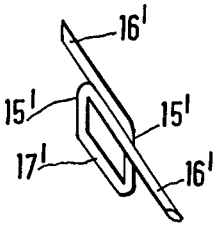
Figure 6C:
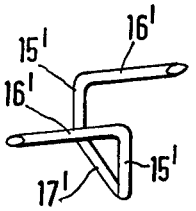

FIG. 6*a* is a perspective representation of a staple which could be used to fasten the components shown in FIG. 1; and FIG. 6*b* and FIG. 6*c* show two possibilities for folding the legs of the staple shown in FIG. 6*a*.

DESCRIPTION OF THE PREFERRED EMBODIMENTS

FIG. 1 shows the invented button with components of a button body 10 which is to be fastened to the front side 12 of a carrier 13, and a fastening body in the form of a staple or curved piece of metal 11, which is situated under the back side 14 of the carrier 13. As shown clearly in FIG. 1, the staple of the first embodiment is configurated for insertion through and detachment from the lower part of the button and for attachment of this lower part to a carrier material without deformation of the fastener. The carrier 13 will preferably be a piece of cloth. The staple 11 is shown in FIG. 1 as having legs 15 with L-shapes. The top ends 16 of the legs 15 lie in a plane perpendicular to the bight 17. The lower portions of the legs or intermediate parts 19 of the L-shaped legs 15 connect the legs to the bight 17. The leg ends or upper portions of the legs 16 and the tips 18 are visibly tapered. The tips or prongs 18 are passed through the back side 14 and the front side 12 of the carrier 13. The bight 17 with the coplanar lower portions 19 is positioned against the backside 14 of the carrier 13. The lower portions 19 are preferably of a length such that when the bight 17 is pushed away from contact with the back side 14 the lower portions 19 are just long enough to fill the aperture extending from the carrier to the upper surface of the lower part, while the legs 15 and ends or upper portions 16 and tips 18 are pressed down within the recesses 25 and 25' in the interior or upper surface of the lower part 20.

The button body 10 is constructed of two parts. One part is the lower part 20 and the other part is an upper part 30, which is introduced or fitted on the lower part 20. According to FIGS. 4 and 5 the lower part 20 is shown in the form of a basin, with a disc-shaped or plate-shaped floor 21 and a circumscribing basin rim 22. This basin wall 22 is provided with an interiorly directed elastically-formed lip 23. The floor 21 provided with two apertures 24, which correspond to the distance of separation of the legs 15 of staple 11. It is through these apertures 24 that the legs 15 are passed. Floor 21 has, on its interior or top surface, recesses in the form of channels 25, 25' which run from the apertures 24 in parallel directions, spaced so as to receive the turned down leg ends or upper portions 16 and prongs 18 of the staple 11. Preferably, each end 16 of the legs is bent in an opposite direction. Such an arrangement of the ends of the legs gives a clamp-like fastening by the staple 11 between the lower part 20 and the cloth or carrier material 13.

The basin-shaped lower part has a bottom surface 27 with a pendent shank 28 protruding downwardly from the bottom surface. This shank 28 provides a reinforcement in the area of the apertures 24, 24'. This reinforcement helps the staple 11 to hold relatively heavy loads without pulling or tearing out. The shank 28 has a length 29, intervening between the underside 27 of the base and the front side 12 of the carrier 13. It is to be understood that the form of the shank will vary with the purpose of application such that the shank may be longer or thicker or thinner in different applications in order to provide a suitable button shank.

Figure 3:
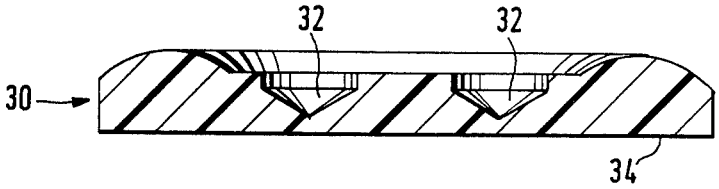
FIG. 3 is an enlarged cross-sectional view of a disc-shaped upper part of the invention.
Figure 4:
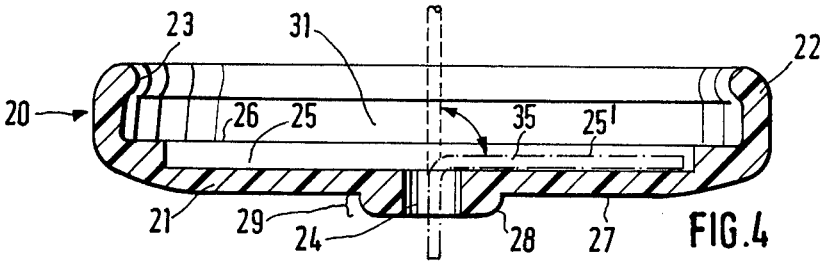
FIG. 4 is an enlarged cross-sectional view of the base of the invention, detailing the lower part along the plane IV—IV shown in FIG. 5.
Figure 5:
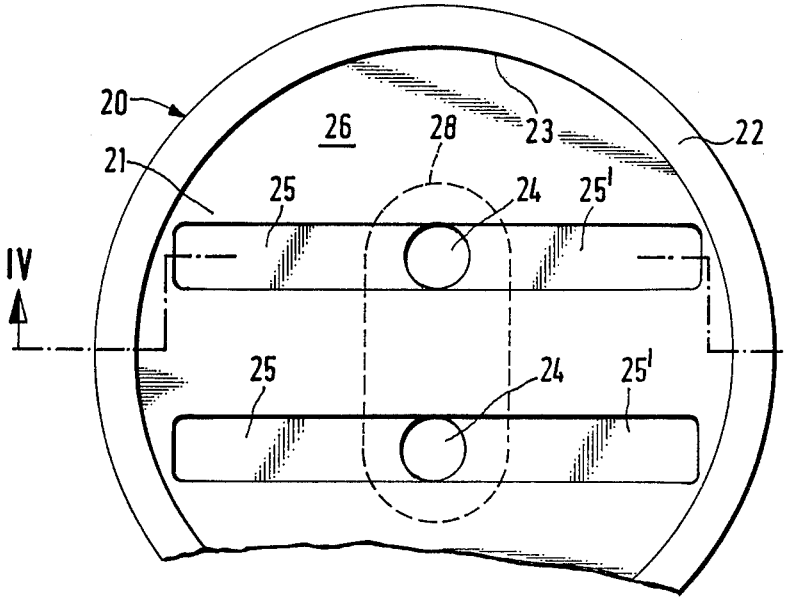
FIG. 5 is a top view of a portion of the lower-part shown in the embodiment of FIG. 4.

The upper part 30 serves as a covering for the inner space 31 of the basin-shaped lower part 20. The upper part 30 is shaped as a disc and has the form of a button, as FIGS. 1 and 3 indicate. The upper part has holes 32, but nothing is passed through these holes. The upper part 30 is constructed so that it can be tightly fitted within the basin-shaped lower part, FIGS. 3 and 4 illustrate the mutually interdependent construction of upper part 30 and lower part 20. By a simple compression of the upper part 30, it is pushed within the elastic lips 23 of the basin rim 22 and after the upper part is inserted, the lips 23 spring back, circumscribing the button body 30 and confining it within inner space 31. In its confined position, the upper part 30 closes off the channels 25 and 25' in which the turned-down ends 16 of the staple 11 are contained. Therefore, this final position of fastening is reliably secure. While the basin part 20 is preferably constructed out of transparent plastic, the upper part 30 is preferably made from a material having a pearly luster, for example, molded polyester. The staple is preferably made from flexible wire such as steel or bronze. Naturally, it is conceivable to use other materials, especially plastic to coat the staple. The number of staple legs and their distance apart can be arbitrarily chosen. It is also conceivable to apply a colored body as the lower part 20 in order to design a contrast with the upper part 30. Also, for example, the basin wall 22 may be formed broader or streamlined or may be designed with patterns. It is also conceivable that the visible or top side of the disc-shaped upper part 30 be provided with designs or patterns, giving a fancy effect.

Figure 2:
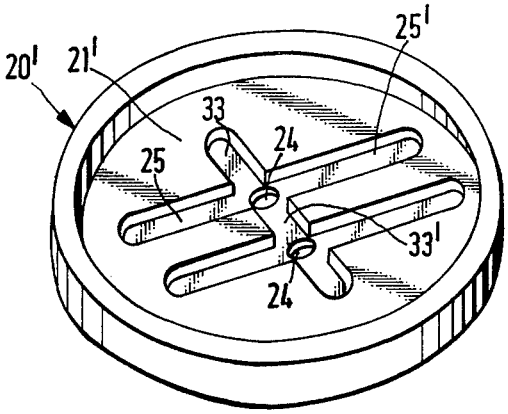
FIG. 2 is a perspective view of another embodiment of the lower part.

In FIG. 2 an averted or turned-away image of basin-shaped lower part 20 is shown in which apertures 24 continues with portions of channels 25, 25' and further channels 33, 33' are provided. The arrangement of the channels on 21' of the lower part 20 appears from a top view to be in the form of "H". It would naturally also be possible to provide more channels in order to present a star- or asterisk-shaped arrangement. It is also conceivable to provide channels with a large area in which an appropriately certain and secure positioning between the floor 21 and the lower surface 34 of the upper part 30 is achieved by locating the turned down staple ends 16 alongside the side walls of the channels.

In FIG. 6*a*, another embodiment of the staple is shown in a simple U-form. The staple legs 15' are constructed as straight lines. They are perpendicular to the bight 17'. There is no intermediate part or bent over portion of the legs. The bight 17' will lie on the underside of the carrier. FIG. 2 shows the base with channels 25, 25', 33, 33' proceeding in different directions. The ends 16' of the staple 11' may be selectively turned around so that they have a different direction. Such a staple form would be appropriate for the base of FIG. 2.

FIGS. 6*b* and 6*c* illustrate this alternate selective bendings of the staple. Regarding FIG. 6*b*, the ends or upper portions 16' of a staple are turned down so that they are parallel to the bight 17'. When turned down, the ends or upper portions 16' will fit in the channels 33, 33' of the lower part 20 shown in FIG. 2. Regarding FIG. 6*c*, the ends or upper portions 16' are bent so that they are in a perpendicular to the plane of the lower portions 15' of the legs and the bight 17'. Relative to the lower part 20 shown in FIG. 2, one end 15' would be contained within a channel 25 and the other would be contained in the channel 25' which is diagonally across from the channel containing the former.

FIG. 4 shows the lower part 20 and shows the sufficient room within the lower part for the turning movement of the ends or upper portions 16 or 16' of the staple. In FIG. 4, the upright position of the ends is illustrated by the interrupted line extending through aperture 24. The turned-down final position of the ends or upper portions 16, 16' within the bed 35 which could represent a channel 25' or 25, is shown in a dashed-dot-dash line.

The construction of the staple 11' shown in FIG. 6*a* is appropriate especially for mechanical installation of the buttons of the invention upon the carrier or cloth. Manually operated or automatic devices may be used in order to place the staples 11'; for the purposes of this invention, an ordinary stapling machine which clamps pieces of paper together and simultaneously bends the clamping ends, is suitable. The supply of the single clamps 11' to such a machine or workpiece can be simplified by glueing or adhering the clamps or staples together in a straight row. This clamp or staple magazine can then be supplied to the customary paper stapler, the staples being inserted by machine or by hand. With an automatically operating machine, one can effect not only the driving in and turning down of the ends of the staples, but also the pressing in of the upper part into the lower part. There is also a good possibility of mass-producing the basin-shaped lower parts 20 and supplying them upon pieces of cloth formed according to the desire of the client or the appropriate nature of the cloth, and then additionally compressing suitable upper parts discs manually into the lower parts 20.

The above-mentioned coating of the staples is useful for the protection of the material of the cloth or carrier from the metallic staple. The above-mentioned channels 25, 25' can consist of a remaining interstice between the lower surface of the upper part 34 and the upper or interior surface 26 of the lower part 20. This insterstice would preferably correspond to the thickness of the turned down ends or upper portions 16, 16' of the staple which lie within the channels. In such a case, the channel would correspond to the above-mentioned inner space 31.

It will be understood that each of the elements described above, or two or more together, may also find a useful application in other types of constructions differing from the types described above.

While the invention has been illustrated and described as embodied in a button designed to be fastened to a carrying material without the use of stitches, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a button with a stitchless fastener, the button including a two-part button body having an upper and lower part to be arranged on the front side of a carrier material, the lower part having a top and bottom surface through which two apertures extend and a recess proceeding along said top surface from said apertures, a fastener in the form of a U-shaped staple, the staple having two legs which each have an end thrust through the back side of the carrier material to emerge on the front side, and passed through the two apertures of the lower part and the protruding portions of the ends of the legs and being received in downwardly deformed condition in the recesses and wherein the upper part is connectable to the lower part and covers the recess-containing upper surface of the lower part, the improvement comprising a form-maintaining fastener having two parallel L-shaped legs projecting from a bight, said fastener having and substantially maintaining this preformed shape wherein the ends of the legs serve to hold the button in place without deformation of the shape of the fastener, wherein the lower part has parallel directed recesses corresponding to the parallel legs and originating from the separate apertures, the recesses defining a turning plane for the ends of the legs upon turning motion of the entire staple; and an upper part connectable to the lower part and operative to confine the ends of the legs and wherein said lower part further has a wall with an inwardly directed rim surrounding said top surface of said lower part, and confining said upper part.

2. A button as defined in claim 1, wherein said staple is a metallic wire.

3. A button as defined in claim 2, wherein said staple is covered with colored material.

4. A button as defined in claim 3, wherein the colored material is plastic.

5. A button as defined in claim 1, wherein the recesses are channels.

6. A button as defined in claim 5, wherein the channels form an H-shape.

7. A button fastener as defined in claim 1, wherein said upper part is disc-shaped and said lower part is basin-shaped and said rim is elastic, said upper part being removably retained within said wall of said lower part.

8. A button as defined in claim 7, wherein said lower part is made of plastic.

9. A button as defined in claim 8, wherein said plastic is transparent.

10. A button as defined in claim 7, wherein said upper part is itself a complete button.

11. A button as recited in claim 1, further comprising a shank upon said bottom surface of said lower part corresponding to the region of said apertures and said channels to reinforce the central portion of said lower part.

12. A button body as recited in claim 1, said fastener having parallel L-shaped legs projecting about 90° from a bight.

* * * * *